US007246417B1

(12) United States Patent
Huang

(10) Patent No.: US 7,246,417 B1
(45) Date of Patent: Jul. 24, 2007

(54) SHOE LACE

(75) Inventor: Ke-Chieh Huang, He Mei Chen (TW)

(73) Assignee: Kae Sheng Webbing Co., Ltd, Changhua, Hsien (TW)

( * ) Notice: Subject to any disclaimer, the term of this patent is extended or adjusted under 35 U.S.C. 154(b) by 80 days.

(21) Appl. No.: 11/104,060

(22) Filed: Apr. 12, 2005

(51) Int. Cl.

| | |
|---|---|
| ***A43C 9/00*** | (2006.01) |
| ***A43C 9/04*** | (2006.01) |
| ***A43C 9/06*** | (2006.01) |
| *A43B 5/00* | (2006.01) |

(52) U.S. Cl. ..... 24/715.6; 24/715.7; 36/50.1

(58) Field of Classification Search ..... 24/712.1
See application file for complete search history.

(56) References Cited

U.S. PATENT DOCUMENTS 1,330,256 A * 2/1920 Gay ..... 24/712.4
1,411,746 A * 4/1922 Ross ..... 24/715.6
1,420,219 A * 6/1922 Ross ..... 24/715.6
1,420,632 A * 6/1922 Kelly ..... 24/715.6
1,586,473 A * 5/1926 Rose ..... 24/715.6
5,638,589 A * 6/1997 Phillips ..... 24/715.6

* cited by examiner

*Primary Examiner*—Robert J. Sandy
(74) *Attorney, Agent, or Firm*—Alan Kamrath; Kamrath & Associates, P.A.

(57) ABSTRACT

A shoe lace includes a lace body having a first end provided with a first connecting member and a second end provided with a second connecting member, and a third connecting member mounted on the second connecting member and detachably combined with the first connecting member. Thus, the two ends of the shoe lace can be combined with each other, so that a user needs not to bind the shoe lace, thereby facilitating the user wearing the shoes by the shoe lace. In addition, the two ends of the shoe lace can be detached from each other easily and rapidly, thereby facilitating the user releasing the shoe lace.

4 Claims, 10 Drawing Sheets

SHOE LACE

BACKGROUND OF THE INVENTION

1. Field of the Invention

The present invention relates to a shoe lace, and more particularly to a shoe lace having a detachable aglet.

2. Description of the Related Art

A conventional shoe lace has two ends each provided with an aglet. However, the aglet is fixed on the shoe lace, so that it is necessary to dispose the whole shoe lace when the aglet is worn out, thereby decreasing the lifetime of the shoe lace. In addition, when the shoe lace is bound on a shoe, the shoe lace easily becomes loosened during a period of time so that the user has to bind the shoe lace again, thereby causing inconvenience to the user.

SUMMARY OF THE INVENTION

The primary objective of the present invention is to provide a shoe lace, wherein the two ends of the shoe lace can be combined with each other, so that a user needs not to bind the shoe lace, thereby facilitating the user wearing the shoes by the shoe lace.

Another objective of the present invention is to provide a shoe lace, wherein the two ends of the shoe lace can be detached from each other easily and rapidly, thereby facilitating the user releasing the shoe lace.

A further objective of the present invention is to provide a shoe lace, wherein the two ends of the shoe lace can be combined with each other, thereby preventing the shoe lace from being becoming loosened.

A further objective of the present invention is to provide a shoe lace, wherein the second connecting member has a pattern formed thereon, so that the aglet of the shoe lace has an outstanding outer appearance, thereby enhancing the aesthetic quality of the shoe lace.

A further objective of the present invention is to provide a shoe lace, wherein the shoe lace has a detachable aglet that can be replaced when being worn out, thereby enhancing the lifetime of the shoe lace.

Further benefits and advantages of the present invention will become apparent after a careful reading of the detailed description with appropriate reference to the accompanying drawings.

DETAILED DESCRIPTION OF THE INVENTION

Figure 1:
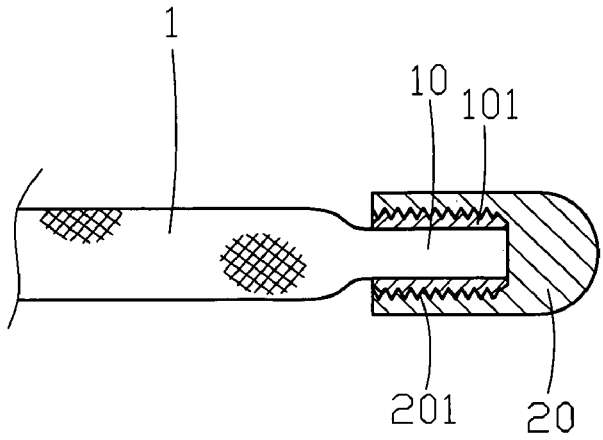
FIG. 1 is a plan cross-sectional assembly view of a shoe lace in accordance with the preferred embodiment of the present invention.
Figure 2:
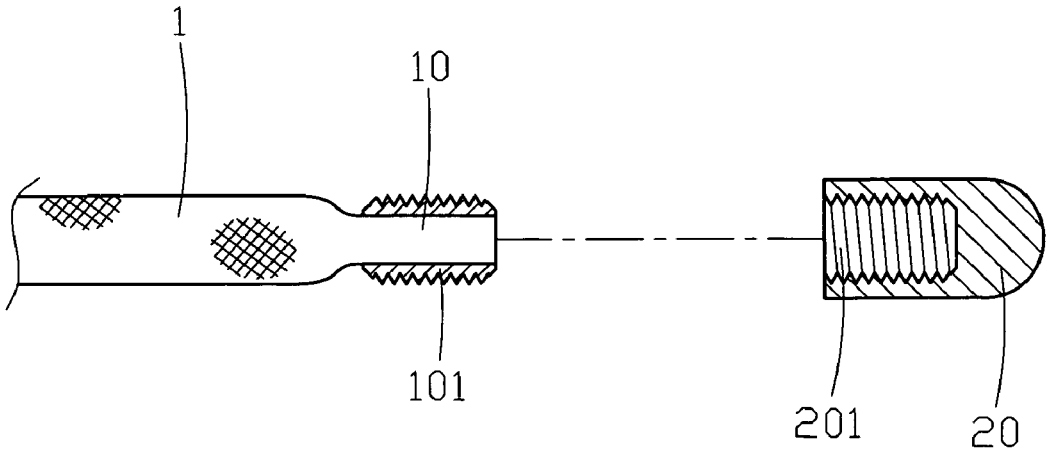
FIG. 2 is a plan cross-sectional exploded view of the shoe lace as shown in FIG. 1.

Referring to the drawings and initially to FIGS. 1 and 2, a shoe lace in accordance with the preferred embodiment of the present invention comprises a lace body 1 having two ends each provided with a first connecting member 10, and a second connecting member 20 detachably mounted on the first connecting member 10. The first connecting member 10 has an outer wall provided with a first fastener 101, and the second connecting member 20 has an inner wall provided with a second fastener 201 detachably secured on the first fastener 101. The second connecting member 20 has a pattern formed thereon. Preferably, the first fastener 101 is an outer thread, and the second fastener 201 is an inner thread screwed onto the first fastener 101.

Figure 3:
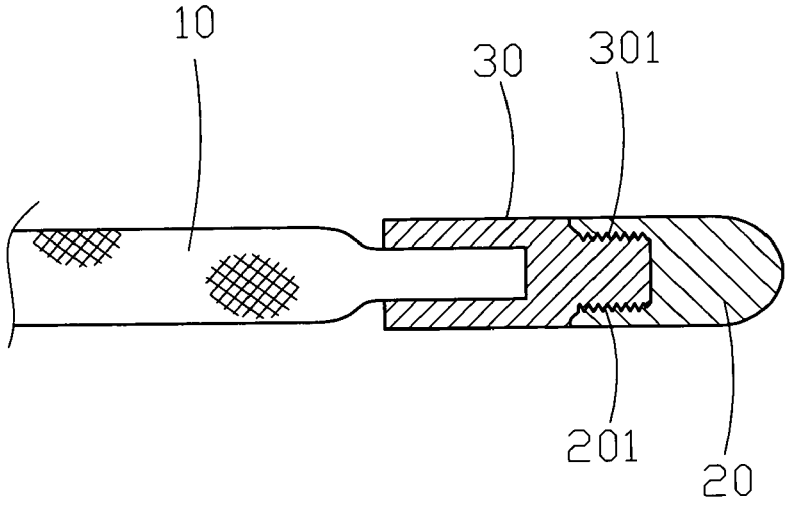
FIG. 3 is a plan cross-sectional assembly view of a shoe lace in accordance with another preferred embodiment of the present invention.
Figure 4:
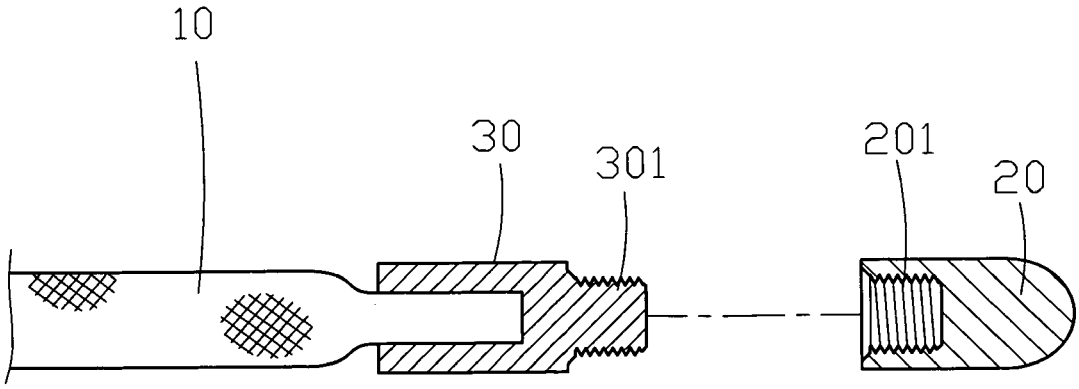
FIG. 4 is a plan cross-sectional exploded view of the shoe lace as shown in FIG. 3.

Referring to FIGS. 3 and 4, the first fastener 30 has a first end mounted on the first connecting member 10 and a second end formed with an outer thread 301 screwed into the second fastener 201.

Figure 5:
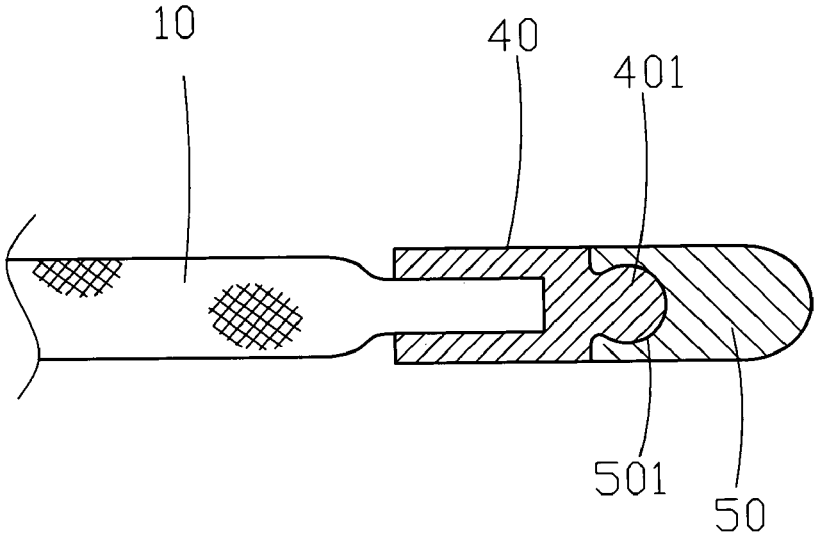
FIG. 5 is a plan cross-sectional assembly view of a shoe lace in accordance with another preferred embodiment of the present invention.
Figure 6:
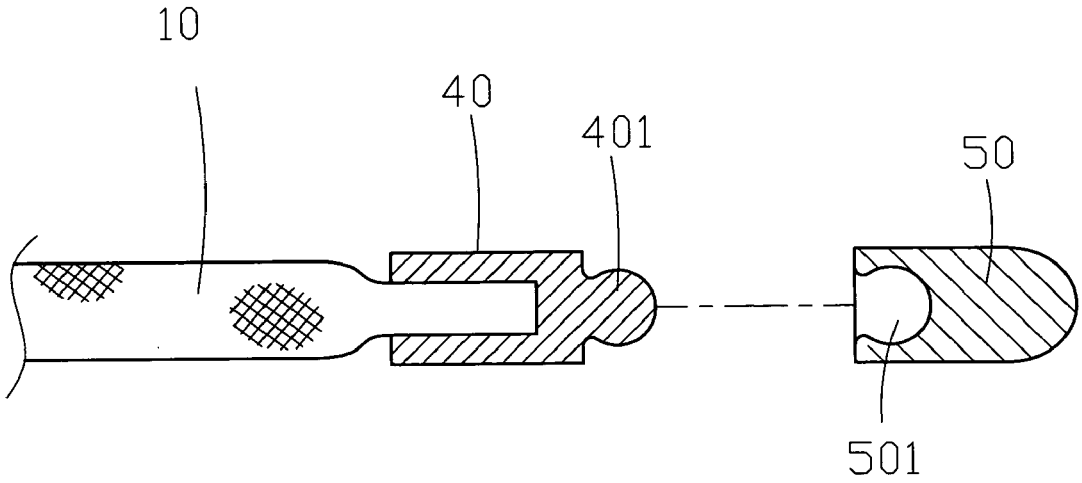
FIG. 6 is a plan cross-sectional exploded view of the shoe lace as shown in FIG. 5.

Referring to FIGS. 5 and 6, the first fastener 40 has a first end mounted on the first connecting member 10 and a second end inserted into the second fastener 501 of the second connecting member 50. The second fastener 501 of the second connecting member 50 is a spherical snapping hole, and the second end of the first fastener 40 is formed with a spherical snapping portion snapped into the second fastener 501 of the second connecting member 50.

Figure 7:
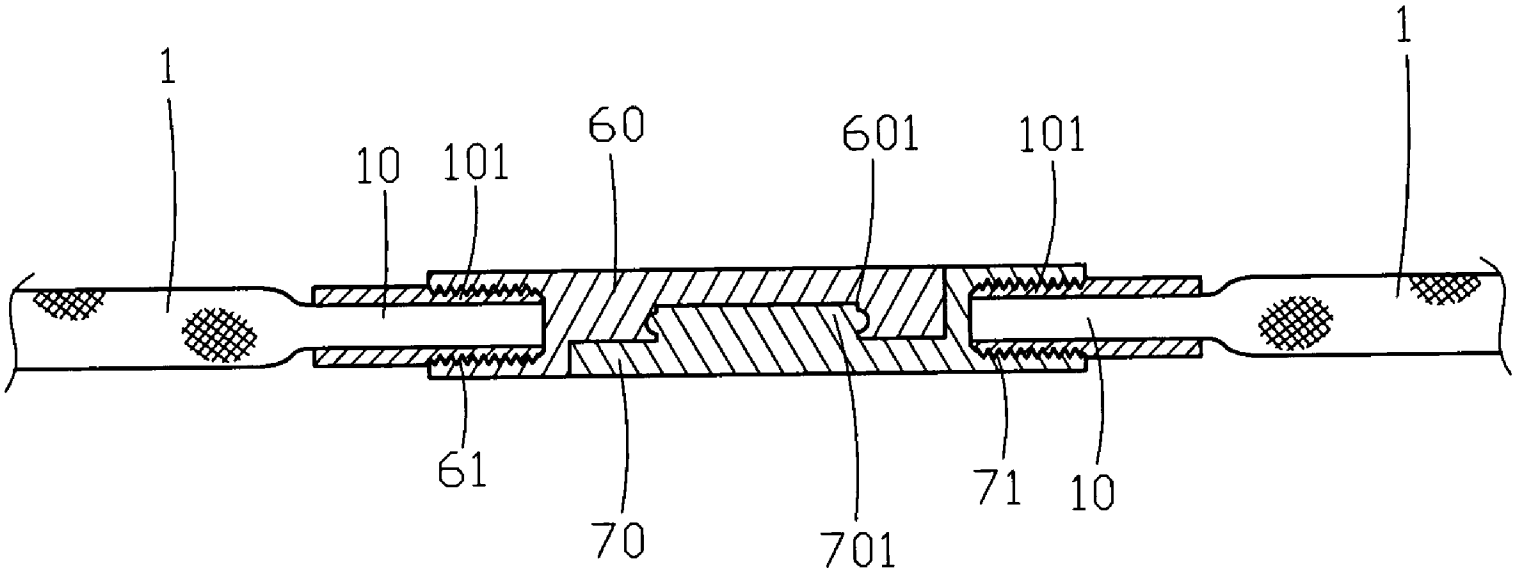
FIG. 7 is a plan cross-sectional assembly view of a shoe lace in accordance with another preferred embodiment of the present invention.
Figure 8:
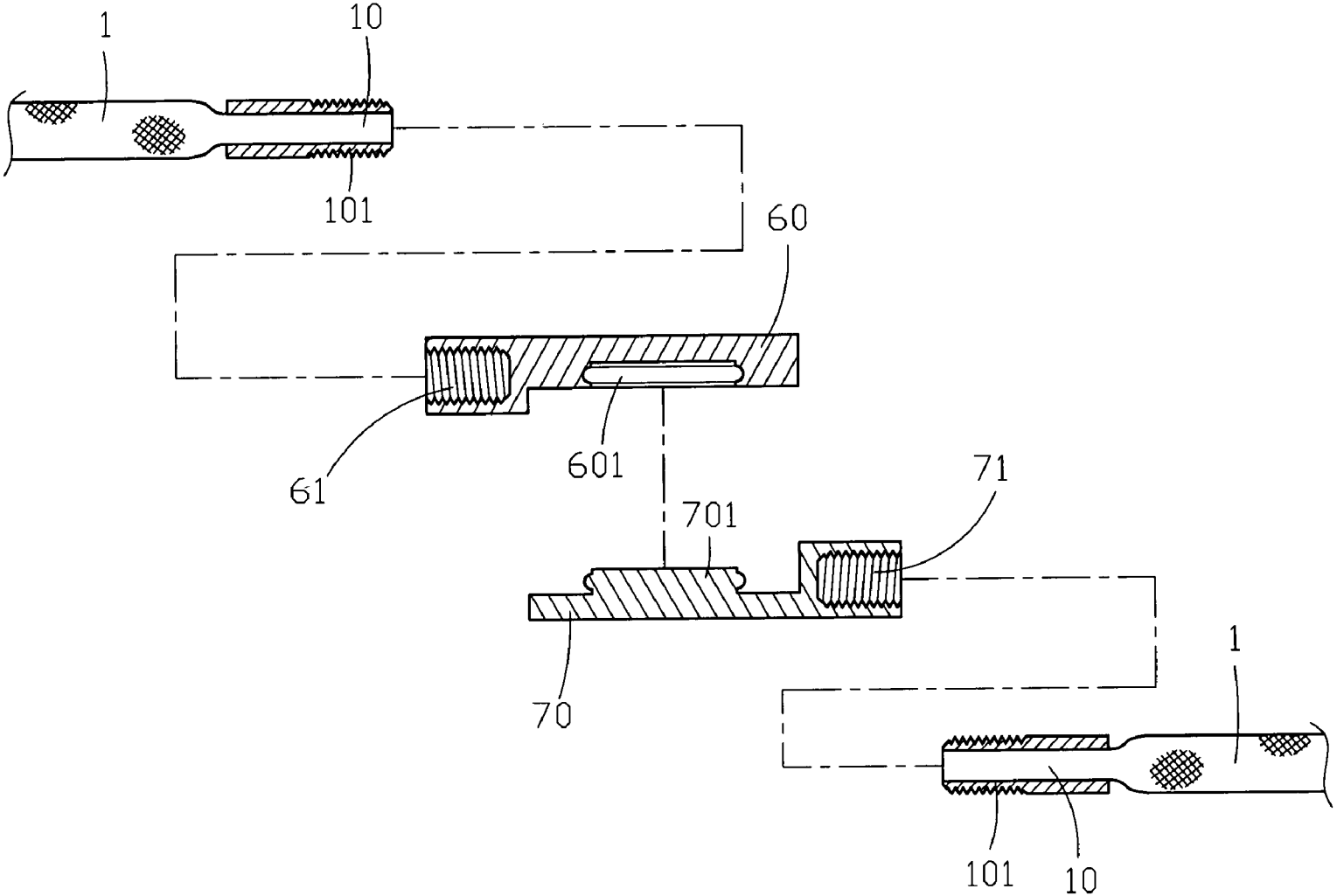
FIG. 8 is a plan cross-sectional exploded view of the shoe lace as shown in FIG. 7.

Referring to FIGS. 7 and 8, a shoe lace in accordance with another preferred embodiment of the present invention comprises a lace body 1 having two ends each provided with a first connecting member 10, a second connecting member 60 detachably mounted on the first connecting member 10 of one of the two ends of the lace body 1, and a third connecting member 70 detachably mounted on the first connecting member 10 of the other one of the two ends of the lace body 1 and combined with the second connecting member 60.

The first connecting member 10 has an outer wall provided with a first fastener 101, the second connecting member 60 has a first end having an inner wall provided with a second fastener 61 detachably secured on the respective first fastener 101, and the third connecting member 70 has a first end having an inner wall provided with a third fastener 71 detachably secured on the respective first fastener 101. Preferably, the first fastener 101 is an outer thread, the second fastener 61 is an inner thread screwed onto the respective first fastener 101, and the third fastener 71 is an inner thread screwed onto the respective first fastener 101. In addition, the second connecting member 60 has a second end having a side provided with a snapping hole 601, and the third connecting member 70 has a second end having a side provided with a snapping portion 701 snapped into the snapping hole 601 of the second connecting member 60.

Figure 9:
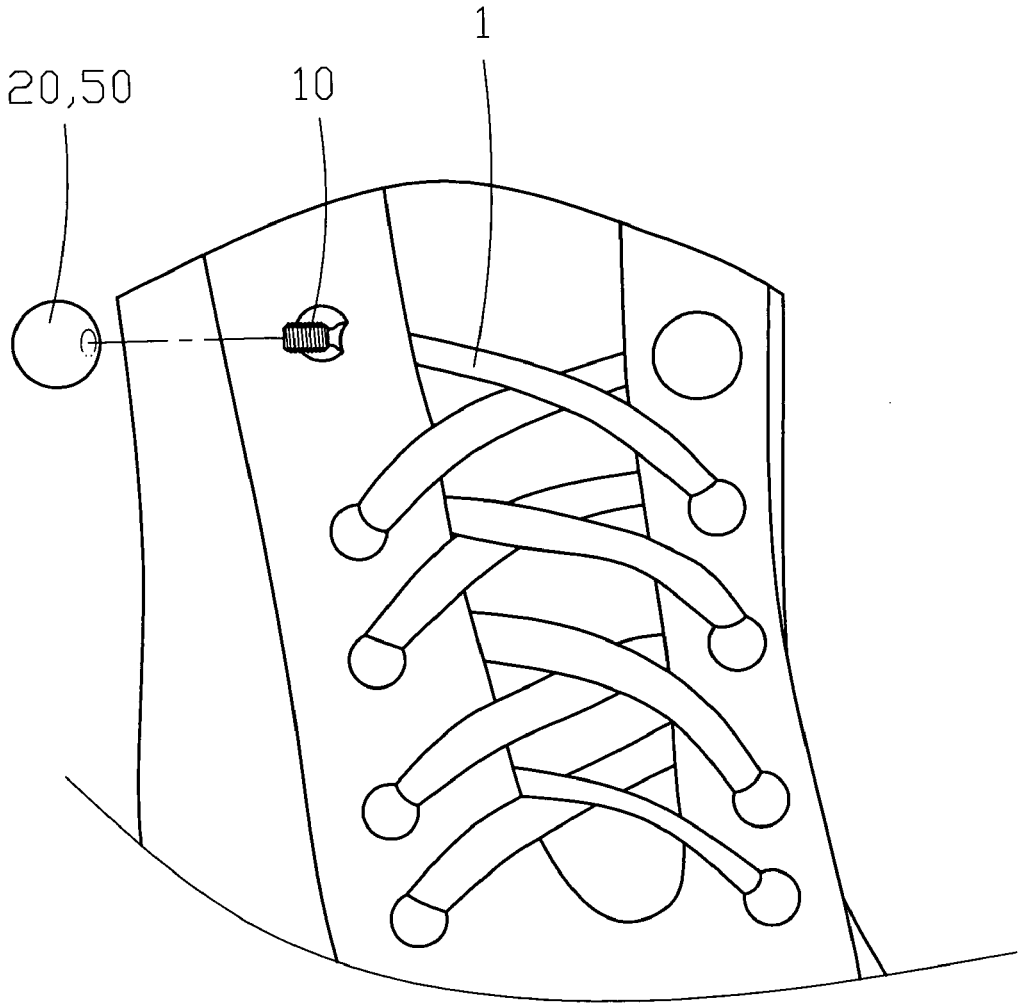
FIG. 9 is a perspective view of a shoe lace in accordance with another preferred embodiment of the present invention.

Referring to FIG. 9, the second connecting member 20 (or 50) has a spherical shape.

Figure 10:
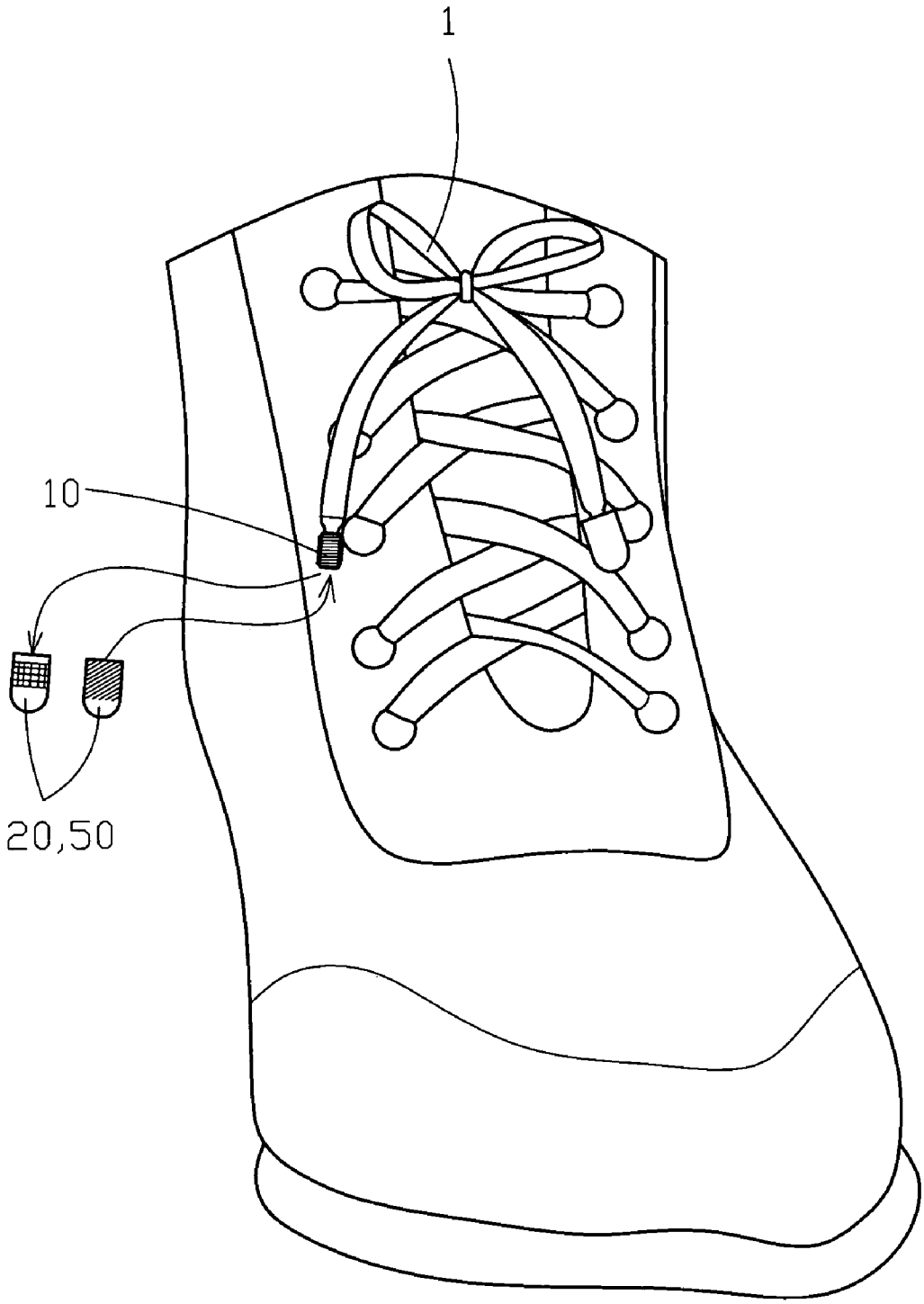
FIG. 10 is a perspective view of a shoe lace in accordance with another preferred embodiment of the present invention.
Figure 11:
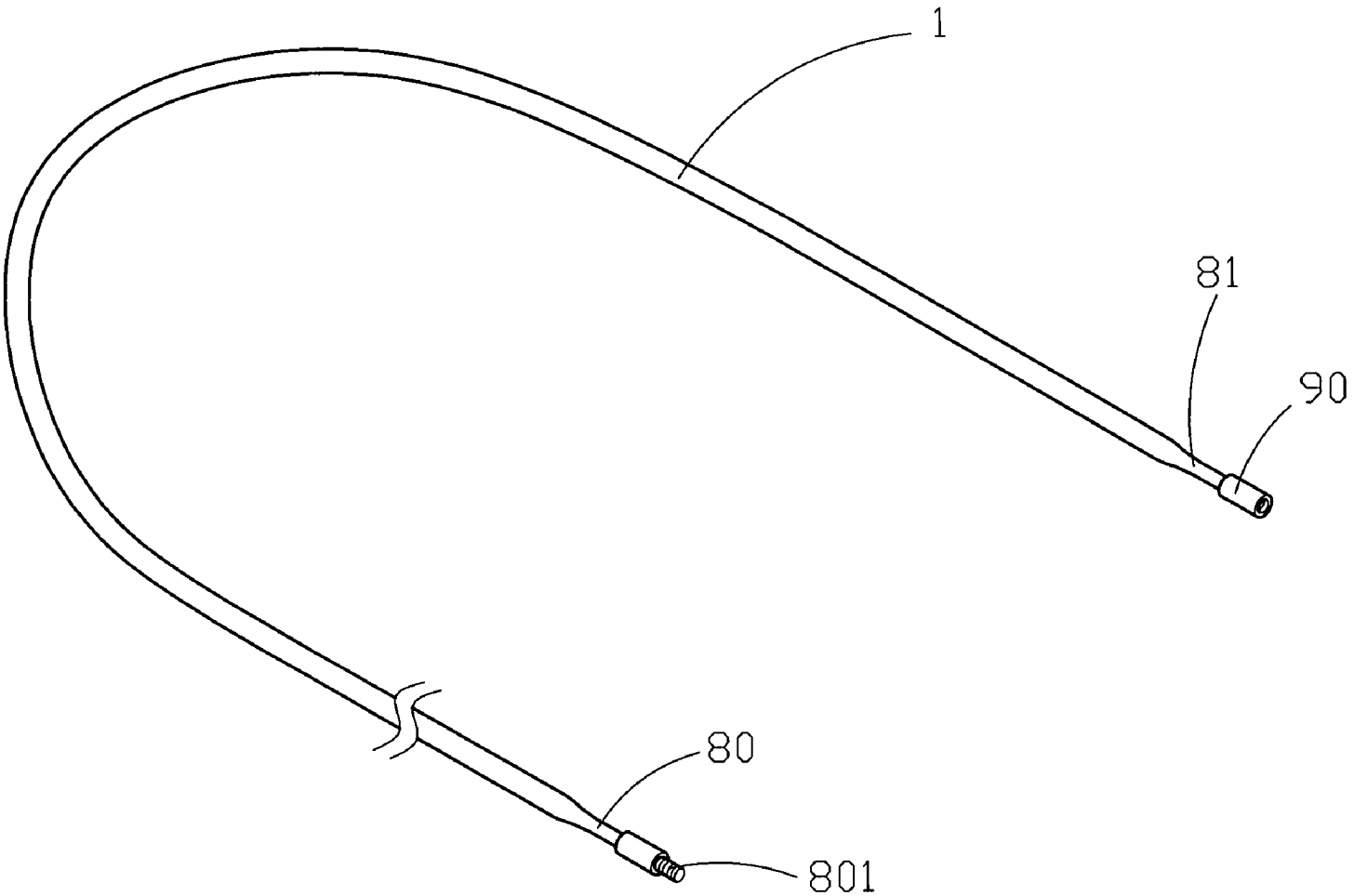
FIG. 11 is a perspective view of a shoe lace in accordance with another preferred embodiment of the present invention.
Figure 12:
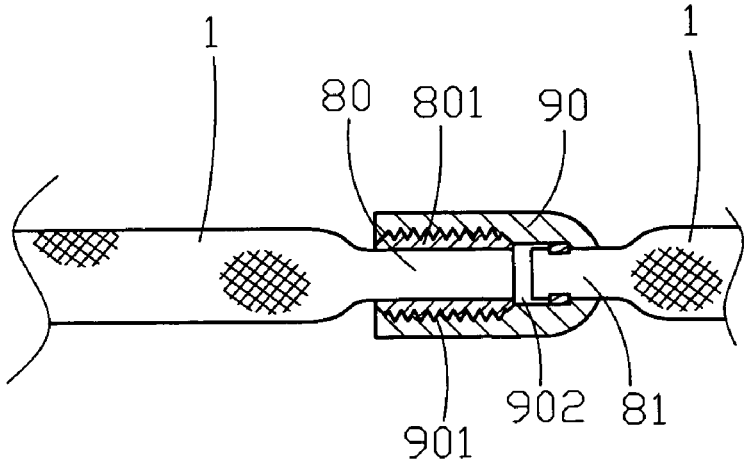
FIG. 12 is a plan cross-sectional exploded view of the shoe lace as shown in FIG. 11.
Figure 13:
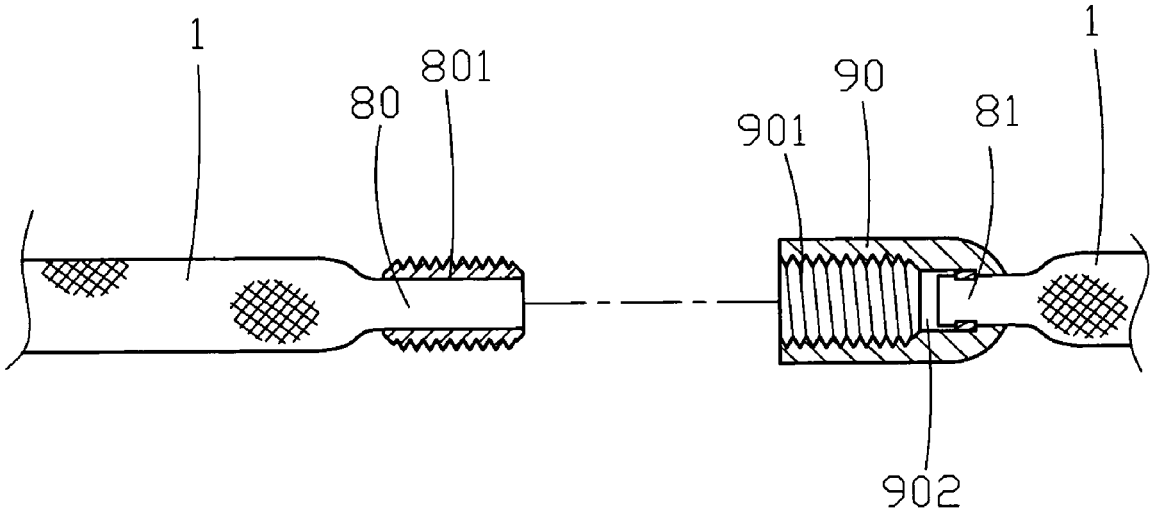
FIG. 13 is a plan cross-sectional assembly view of the shoe lace as shown in FIG. 12.
Figure 14:
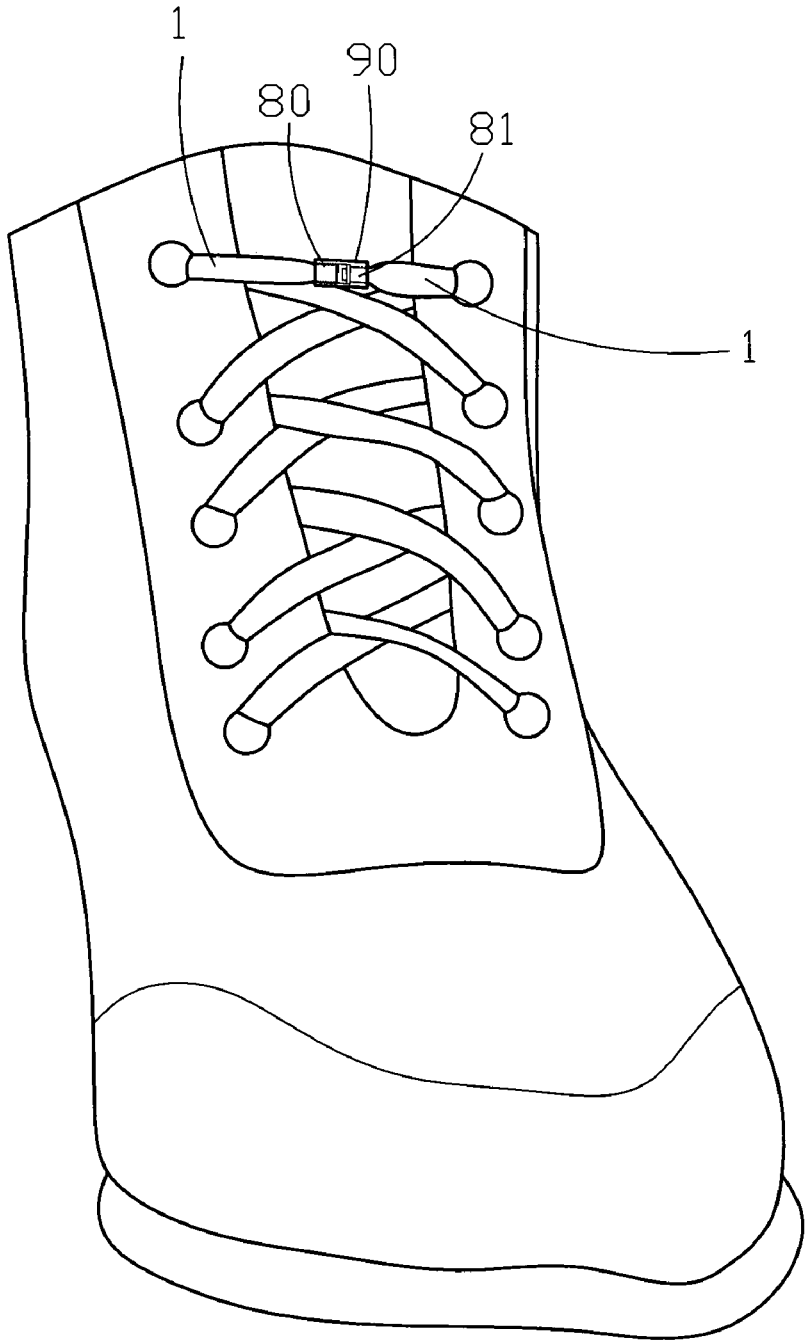
FIG. 14 is a perspective assembly view of the shoe lace as shown in FIG. 11.

Referring to FIG. 10, the second connecting member 20 (or 50) has a pattern formed thereon.

Referring to FIGS. 11–14, a shoe lace in accordance with another preferred embodiment of the present invention comprises a lace body 1 having a first end provided with a first connecting member 80 and a second end provided with a second connecting member 81, and a third connecting member 90 mounted on the second connecting member 81 and detachably combined with the first connecting member 80. The third connecting member 90 has a first end rotatably mounted on the second connecting member 81 and a second end detachably combined with the first connecting member 80. The first end of the third connecting member 90 has an inner wall formed with a snapping portion 902 snapped onto the second connecting member 81. The first connecting member 80 has an outer wall formed with an outer thread 801, and the second end of the third connecting member 90 has an inner wall formed with an inner thread 901 screwed onto the outer thread 801 of the first connecting member 80.

Accordingly, the two ends of the shoe lace can be combined with each other, so that a user needs not to bind the shoe lace, thereby facilitating the user wearing the shoes by the shoe lace. In addition, the two ends of the shoe lace can be detached from each other easily and rapidly, thereby facilitating the user releasing the shoe lace. Further, the two ends of the shoe lace can be combined with each other, thereby preventing the shoe lace from being becoming loosened. Further, the second connecting member 20 (or 50) has a pattern formed thereon, so that the aglet of the shoe lace has an outstanding outer appearance, thereby enhancing the aesthetic quality of the shoe lace. Further, the shoe lace has a detachable aglet that can be replaced when being worn out, thereby enhancing the lifetime of the shoe lace.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shoe lace, comprising:

a lace body having two ends each provided with a first connecting member;

a second connecting member detachably mounted on the first connecting member of one of the two ends of the lace body;

a third connecting member detachably mounted on the first connecting member of the other one of the two ends of the lace body and combined with the second connecting member;

wherein the first connecting member has an outer wall provided with a first fastener, the second connecting member has a first end having an inner wall provided with a second fastener detachably secured on the respective first fastener, and the third connecting member has a first end having an inner wall provided with a third fastener detachably secured on the respective first fastener;

the first fastener is an outer thread, the second fastener is an inner thread screwed onto the respective first fastener, and the third fastener is an inner thread screwed onto the respective first fastener.

2. The shoe lace in accordance with claim 1, wherein the second connecting member has a second end having a side provided with a snapping hole, and the third connecting member has a second end having a side provided with a snapping portion snapped into the snapping hole of the second connecting member.

3. A shoe lace, comprising:

a lace body having a first end provided with a first connecting member and a second end provided with a second connecting member;

a third connecting member mounted on the second connecting member and detachably combined with the first connecting member;

wherein the third connecting member has a first end rotatably mounted on the second connecting member and a second end detachably combined with the first connecting member;

the first connecting member has an outer wall formed with an outer thread, and the second end of the third connecting member has an inner wall formed with an inner thread screwed onto the outer thread of the first connecting member.

4. The shoe lace in accordance with claim 3, wherein the first end of the third connecting member has an inner wall formed with a snapping portion snapped onto the second connecting member.

* * * * *